US005617633A

United States Patent [19]

Lee

[11] Patent Number: 5,617,633

[45] Date of Patent: Apr. 8, 1997

[54] FINGER/TOE NAIL CLIPPER ASSEMBLY

[76] Inventor: Hee U. Lee, 9237 Austin, Morton Grove, Ill. 60053

[21] Appl. No.: 488,925

[22] Filed: Jun. 9, 1995

[51] Int. Cl.[6] ..... A45D 29/02

[52] U.S. Cl. ..... 30/28; 132/75.5

[58] Field of Search ..... 30/28, 29; 132/75.5

[56] References Cited

U.S. PATENT DOCUMENTS

| | | | |
|---|---|---|---|
| 860,975 | 7/1907 | Havell | 30/28 |
| 2,515,825 | 7/1950 | Bilsky | 30/28 |
| 5,488,772 | 2/1996 | Dababneh et al. | 30/28 |

*Primary Examiner*—Douglas D. Watts
*Attorney, Agent, or Firm*—Sidney N. Fox

[57] ABSTRACT

A finger/toe nail clipper assembly 10 comprises a lower arm 2 unitary with vertical side walls 4 and 6. The arms 2 and 14 are spaced in overlying arrangement, fastened at one end 8 and terminating in spaced facing jaw formations 14*a* and 2*a*. The jaw formations 14*a* and 2*a* comprise concave center blade sections 32 and 34 and angular side blade sections 42 and 44 that terminate in sharpened cutting edges and engage the center blade sections 32 and 34 and the side walls 4 and 6. The side blade sections 42 and 44 function as movable slots to fit various-sized finger/toe nails. When the blades 32 and 34 and 42 and 44 are engaged in "cutting" position, the interior chamber 24 of the device 10 is completely enclosed by the interior facing surfaces of the arms 2 and 14, side walls 4 and 6, and blade sections 32 and 34 and 42 and 44. The invention 10 eliminates the deflection and obstruction problems caused by the conventional mounting pin by providing other mounting means for the actuating lever. The front edges of the side walls 4 and 6 proximate the jaw formations 14*a* and 2*a* include passage means 46 to receive projection means 52*b* and 52*e* in order to mount the actuating lever 16. The actuating lever 16 comprises a stationary front plate 52 mounted to the side walls 4 and 6 and a rotating portion 17, fastened together by a rivet 18, allowing pivoting of the actuating lever 16 from active to inactive condition and vice versa. Portions of the side walls 4 and 6 provide side barriers, preventing the actuating lever 16 from slipping sideways during use. Disposal means include a disposal hatch 12 fastened to the undersurface of the lower arm 2 by a rivet 22. The disposal hatch 12 may be swung sideways about the rivet 22 to reveal the opening 2*c* in the lower arm 2 to release accumulated clippings in a controlled manner.

38 Claims, 7 Drawing Sheets

FIG. 11
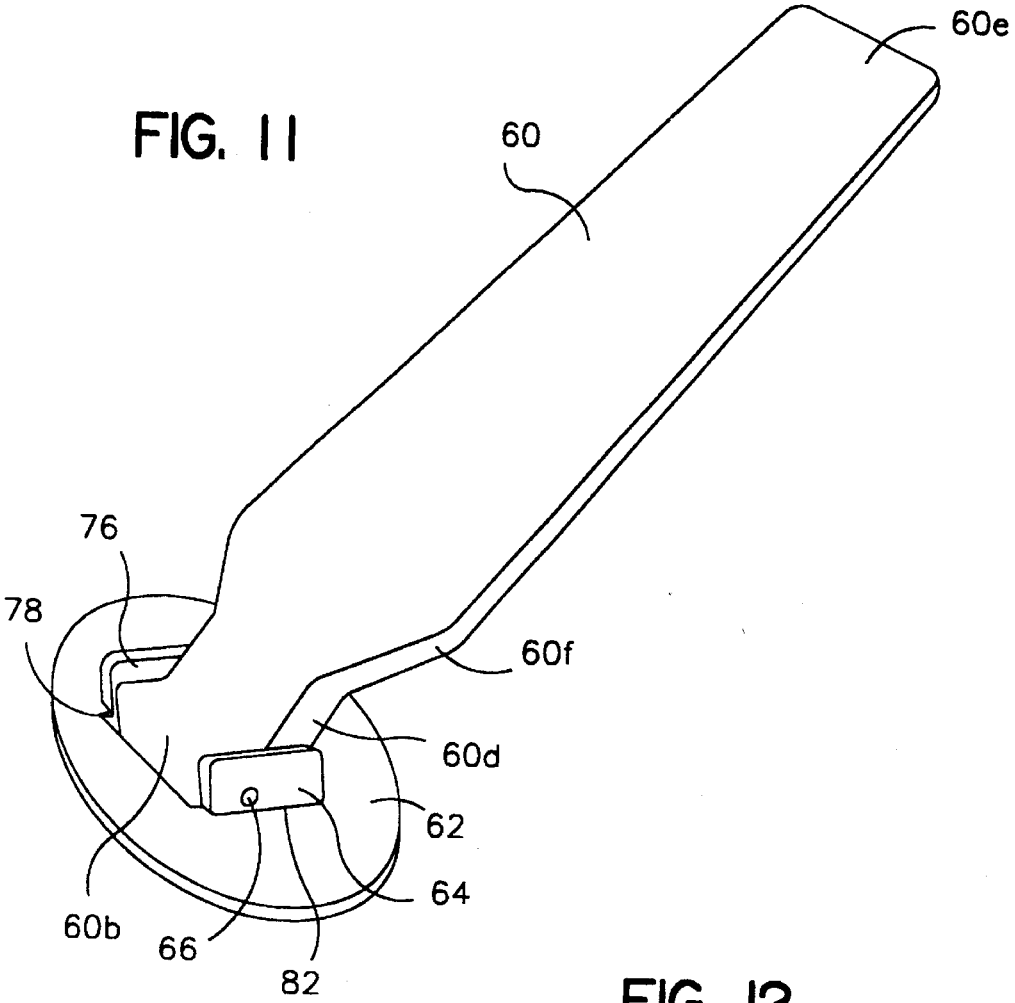
FIG. 12
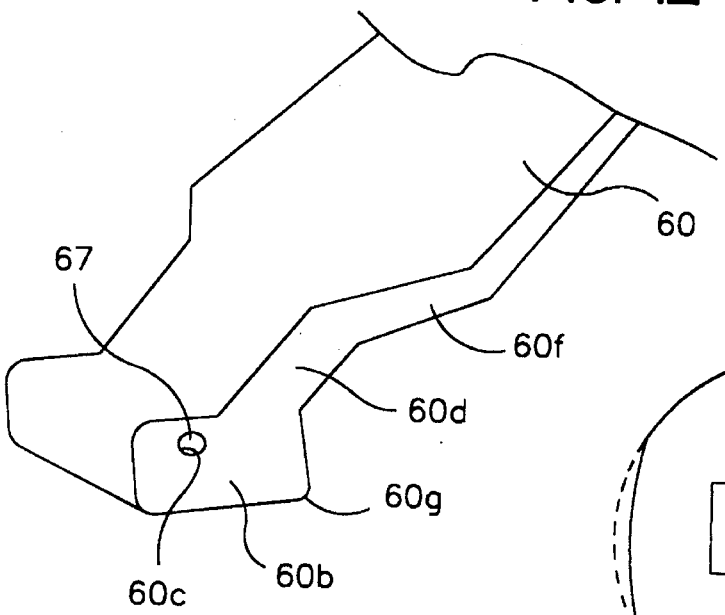
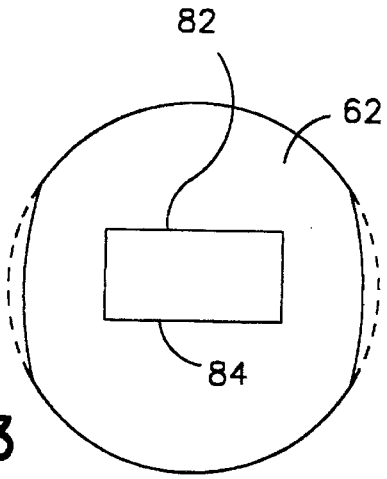
FIG. 13

FINGER/TOE NAIL CLIPPER ASSEMBLY

BACKGROUND—FIELD OF THE INVENTION

The present invention relates in general to a finger/toe nail clipper and catcher, and more specifically, the present invention relates to a device that prevents nail clippings from scattering during use of the finger/toe nail clipper and catcher and offers an effective means of catching and disposing of the accumulated nail clippings.

BACKGROUND—PRIOR ART

The conventional finger/toe nail clipper devices generally are made up of a pair of elongate arms arranged overlying and co-extensive. The upper arm has limited resilience while the lower arm is rigid. The longitudinal sides are generally open. The rear ends of the arms are secured. The front ends of the arms terminate in jaw formations, each arm terminating in cutting edges spaced apart slightly. The actuating lever is provided coupled to mounting means proximate the jaw formations.

The conventional mounting means of the actuating lever consist of a mounting pin having a head at one end and a passage at the other end. Each arm has a hole adjacent to the jaw area. These holes are aligned. The mounting pin passes through the aligned holes. The mounting pin, when conventionally installed, partially blocks the way between the jaws of the clipper, which limits the entry of the finger/toe nail. Also, the mounting pin obstructs the flow of the nail clippings toward the interior area of the clipper, resulting in the uncontrolled dispersal of finger/toe nail clippings common to the use of the conventional finger/toe nail clipper device.

While prior art has attempted to address these results through various proposed structures, none of the proposed structures have been totally successful in controlling the scattering of finger/toe nail clippings. Also, the removal of clippings from the storage areas of the prior art finger/toe nail clipper is difficult.

In order to provide background information so that the invention may be completely understood and appreciated in its proper context, reference is made to a number of prior art patents as follows:

U.S. Pat. Nos. 5,072,511; 5,150,521; 4,640,011; 5,195,544; 4,984,366; 4,996,771; 5,131,146; 4,614,031; 4,419,134; 4,574,475; and 5,261,160.

The Ro U.S. Pat. No. 5,072,511 discloses an attempt to deal with these difficulties. The structure involves a recess formed in the side walls to facilitate controlled catching and discharge of the clippings. While the structure does contain many clippings within the chamber formed by the side walls, there are open slots between the side walls and jaw formations that permit escape of some of the clippings that have rebounded from the interior surfaces of the jaws and the mounting pin, leaving a retrieval problem which was sought to be avoided. Also, the Ro clipper appears to require considerable shaking to discharge any clippings jammed in the interior, rear narrow portion of the clipper.

The U.S. Pat. No. 5,150,521 to Han provides a separate nail collecting box into which the nail clipper is slipped. A cover frictionally is engaged over a conventional clipper to retain the clippings. The Han solution requires a two-piece unit that is likely to be expensive to manufacture and difficult to separate in order to dispose of the accumulated clippings.

The Gamble U.S. Pat. No. 4,640,011 describes a hinged retainer with side walls that close off the side openings of the clipper. When the retainer section is dropped, the nail clippings fall out. However, to remove the nail clippings in the rear area of the interior chamber, the retainer must still be removed from the conventional nail clipper. Shaking is still required to dispose of clippings caught in the rear portion of the clipper.

U.S. Pat. No. 5,195,544 illustrates a sheath into which the conventional nail clipper is lodged. The sheath must be removed from the conventional clipper in order to discharge the accumulated clippings within the chamber. An additional element for collection and the separation of such element to remove the clippings is required, making it burdensome for the user.

U.S. Pat. No. 4,984,366 demonstrates another slip-on device whereby a tubular element is fitted onto the conventional clipper. However, the tube does not extend to the mouth of the clipper, still allowing escape of nail clippings deflected from the mounting pin and the interior of the blades out of the side slots.

The Williams U.S. Pat. No. 4,996,771 shows a clipper with a retainer and catching mechanism that catches nail clippings in the forward position and empties the clippings when in the rearward position. Random nail clippings may still deflect from the mounting pin.

The Leininger U.S. Pat No. 5,131,146 exhibits a receptacle that has a rear sleeve which receives the rear part of the finger/toe nail clipper as well as a front shield that receives the front portion of the finger/toe nail clipper and accommodates the nail clippings resulting from use of the clipper device. The front shield is attached to the rear sleeve by a "live" hinge that allows the front sleeve to be pulled away from the body of the clipper device about the hinge, enabling release of the clippings collected within the interior of the device. The interior side walls of the front shield engage to the lower arm of the clipper device. While the Leininger attachment may reduce the amount of scattered clippings, there is still a problem of uncontrolled dispersal with a portion of the clippings since they may, again, deflect from the mounting pin and out the open mouth of the cutting edges. Moreover, the Leininger shield and sleeve unit is a plastic molded product that fits a particular size clipper device, necessitating several sizes of the shield/sleeve unit. Also, it is likely that the plastic molded receptacle will not last an adequate useful life.

The Chen U.S. Pat. No. 4,614,031 divulges a nail clipper with a lower stationary base and side walls that house the clippings within the clipper device. However, there are side slots between the jaw formations and the side walls of the base where random nail clippings may escape.

The Bumbera U.S. Pat. No. 4,419,134 evinces an attempt to eliminate the deflection problem of the mounting pin by mounting the actuating lever by means of the end of the actuating lever hooked on the band circled around the lower and upper arms of the clipper. The Bumbera structure has open side walls, which still allows the scattered escape of nail clippings. However, even if the Bumbera design had side walls, the band would prevent the front portion of the clipper to be shielded, resulting in incomplete protection against scattered escape.

U.S. Pat. No. 4,574,475 to Lee presents side walls extending from the jaw area and terminating at the rear area of the device. However, the Lee structure allows for nail clippings to be caught in the narrowed rear portion of the device, resulting in difficult removal of the clippings. Also, forward opening end notches or slots in the side walls allow the passage of random nail clippings.

The Castagna U.S. Pat. No. 5,261,160 also introduces side walls to shield the length of the nail clipper. However, the conventional mounting pin still presents the problem of deflection.

Whatever the precise merits, features, and advantages of the above cited references, none of them achieves or fulfills the purposes of the present invention.

SUMMARY OF THE INVENTION

Several objects of the present invention are:

(1) to allow greater protection against dispersal of nail clippings by complete enclosure of the interior during use;

(2) to eliminate deflection of clippings off of the conventional mounting pin by providing alternate mounting means for the actuating lever;

(3) to allow various-sized nails to be clipped without sacrificing complete enclosure of the interior during use;

(4) to provide more controlled means for removing the accumulated nail clippings by a simple mechanism without any separate attachment units;

(5) to simplify the manufacture and operation of the device;

(6) to present a single unit free from the need for separate units suggested by prior art.

In accordance with the present invention, a finger/toe nail clipper and catcher comprises vertical side walls unitary with the elongate lower arm of the clipper device, said side walls formed along the longitudinal edges of said elongate upper and lower arms to shield the area between said arms along the continuous length of the device. Said elongate upper arm is of limited resilience and bends downward towards the rear end of the clipper and is tightly secured to the elongate lower arm at the rear of the device by a rivet and spot welding. Preferably, a disposal hatch on the undersurface of said lower arm will cover an opening in said lower arm proximate the rear of the device, said disposal hatch mounted to the device by the same rivet fastening said upper and lower arms. Said disposal hatch swings sideways about said rivet to expose said hole in said lower arm. The upper and lower arms terminate in the front area of the device in spaced and facing jaw formations, said jaw formations having concave center blade sections and side blade sections engaged between said center blade sections and the beginnings of said side walls, said side blade sections serving as movable slots, said center and side blade sections with terminal cutting edges, said arms and side walls completely enclosing the interior chamber when the blade sections are engaged in the "cutting" position. Means mounting said actuating lever will enable rotational pivoting of said actuating lever. Preferably, said actuating lever comprises a stationary front plate and a rotating portion, a rivet tightly fastens said rotating portion to said front plate, said front plate mounted to said side wails, thus preventing pivoting movement of said actuating lever when said actuating lever is in active position and allowing pivoting movement of said actuating lever when said actuating lever is vertically raised to proceed to inactive position.

BRIEF DESCRIPTION OF THE DRAWINGS

FIG. 11 is a perspective view of the modified actuating lever and rotational disc used in the finger/toe nail clipper in FIG. 8.

FIG. 12 is a fragmentary view of the actuating lever in FIG. 11.

FIG. 13 is a top view of the rotational disc means in FIG. 8.

LIST OF REFERENCE NUMERALS

Figure 1:
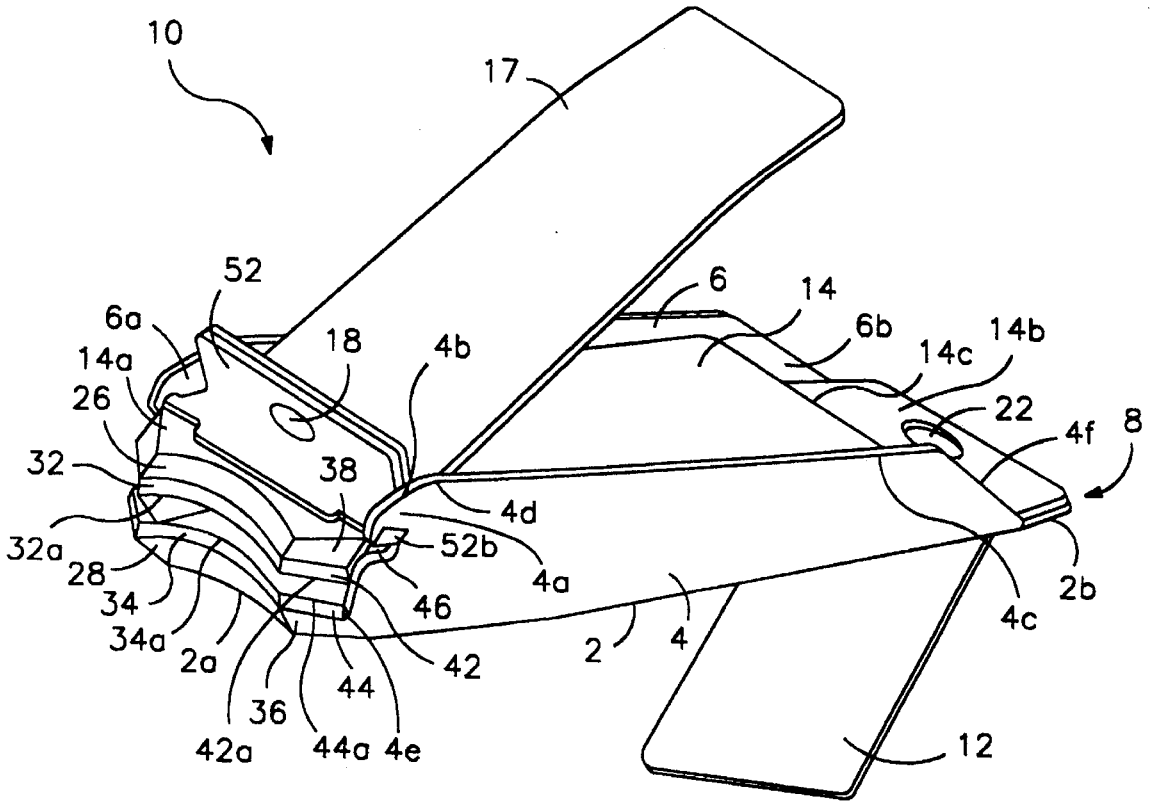
FIG. 1 is a perspective view of the preferred finger/toe nail clipper in accordance with the present invention with the preferred actuating lever in active position and with the preferred disposal hatch extended sideways.

2 lower arm
**2*a*** lower arm's jaw formation
**2*b*** lower arm's rear fastened end
**2*c*** lower arm's opening for disposal
4 side wall
**4*b*** side wall's front edge
**4*c*** side wall's upper edge
**4*d*** dip
**4*e* bend where side wall 4 meets lower arm 2 and lower side blade section 36**
**4*f*** side wall's diagonal upper edge
6 side wall
**6*a*** side wall's front edge
**6*b*** side wall's diagonal upper edge
8 fastened end
10 preferred embodiment
12 disposal hatch
13 angled deflector
14 upper arm
**14*a*** upper arm's jaw formation
**14*b*** upper arm's fastened portion
**14*c*** point where upper arm bends downward
15 lower arm's opening
16 actuating lever

17 actuating lever's rotating portion
17*a* angled portion
17*b* grasping end
17*c* elongate section with cavity
17*e* heel formation
17*f* angled portion
17*g* rounded edge
18 rivet fastening rotating portion 17 to front plate 52
20 invention with modified disposal means
22 rivet fastening upper 14 and lower 2 arms and disposal hatch 12
24 interior chamber
26 upper concave center section
28 lower concave center section
30 invention with modified mounting means and modified actuating lever
32 upper concave center blade section
32*a* sharpened cutting edge of upper concave center blade section 32
34 lower concave center blade section
34*a* sharpened cutting edge of lower concave center blade section 34
36 lower angular side section
38 upper angular side section
42 upper angular side blade section
42*a* sharpened cutting edge of upper angular side blade section 42
44 lower angular side blade section
44*a* sharpened cutting edge of lower angular side blade section 44
46 passage means (socket)
52 front plate
52*a* front plate's angled portion
52*b* front plate's protruding end
52*c* front plate's rounded front edge
52*e* front plate's protruding end
60 modified actuating lever
60*b* base
60*c* cavity
60*d* indented portion
60*e* grasping edge
60*f* diagonally indented portion
60*g* modified actuating lever's 60 heel formation
62 planar member
64 mounting ear
66 mounting ear's cavity
68 indented parallel section of side wall 4
70 diagonal indentation of side wall 4
72 diagonal indentation of side wall 4
74 passage means (slots)
76 mounting ear
78 axial passage
82 edge of axial passage
84 edge of axial passage, opposite of 82

DESCRIPTION OF THE PREFERRED EMBODIMENT

The preferred embodiment of the present invention (designated by character reference 10) will now be described in connection with FIGS. I through 5 of the drawing. Refer now to FIG. 1, which is an overall drawing of the preferred embodiment of the invention 10.

The finger/toe nail clipper and catcher 1 0 has an elongate upper arm 14 and elongate lower arm 2 that are generally spaced in overlying arrangement. Said elongate arms' 2 and 14 longitudinal edges are parallel or nearly parallel. Said upper arm 14 bends downward at 14*c* proximate the fastened end 8 of the device 10. The finger/toe nail clipper and catcher 10 has vertical side walls 4 and 6 that shield the open longitudinal sides of the overlying upper arm 14 and lower arm 2. The elongate lower arm 2 is unitary with the vertical side walls 4 and 6 along the longitudinal edges of the lower arm 2 from proximate the fastened end of the device 8 to the beginning of the elongate lower arm's 2 jaw formation 4*e*.

The rear ends of the elongate upper arm la and lower arm 3*a* are highly secured together. The opposite ends of the elongate upper arm 14 and the elongate lower arm 2 end in spaced facing jaw formations 14*a* and 2*a*. The jaw formations 14*a* and 2*a* have concave center sections 26 and 28 and angular side sections 36 and 38 on either side of said concave center sections 26 and 28. The concave center sections 26 and 28 of the jaw formations 14*a* and 2*a* have tapered blades 32 and 34 that end in sharpened cutting edges 32*a* and 34*a*. The angular side sections 36 and 38 have tapered blades 42 and 44 that terminate in sharpened cutting edges 42*a* and 44*a*.

The side walls 4 and 6 have diagonal upper edges 4*f* that gradually extend upward and flatten out at 4*c* until making a dip 4*d* proximate the jaw formations 14*a* and 2*a*. The front edge 4*b* of each side wall 4 dips down and terminates in a hook-like socket 46.

An interior chamber 24 of the device 10 is isolated by the interior facing surfaces of the lower arm 2, upper arm 14, side walls 4 and 6, jaw formations 14*a* and 2*a*, blades 32 and 34 and 42 and 44, and cutting edges 32*a* and 34*a* and 42*a* and 44*a*. When the cutting edges 32*a* and 34*a* and 42*a* and 44*a* bear against each other to cut a finger/toe nail, the interior chamber 24 is completely enclosed, preventing dispersal of finger/toe nail clippings.

The present invention does not have the mounting pin found in the conventional finger/toe nail clipper. The lack of a mounting pin eliminates problems with the conventional clipper. The lack of a mounting pin means that (1) there is no structure to obstruct the smooth entry of various-sized finger/toe nails between the jaw formations and (2) there is no structure in the path of the clippings that could deflect said clippings to the exterior of the device 10. Thus, in the present invention, there is no mounting pin, and other mounting means for the actuating lever are proposed.

Figure 3:
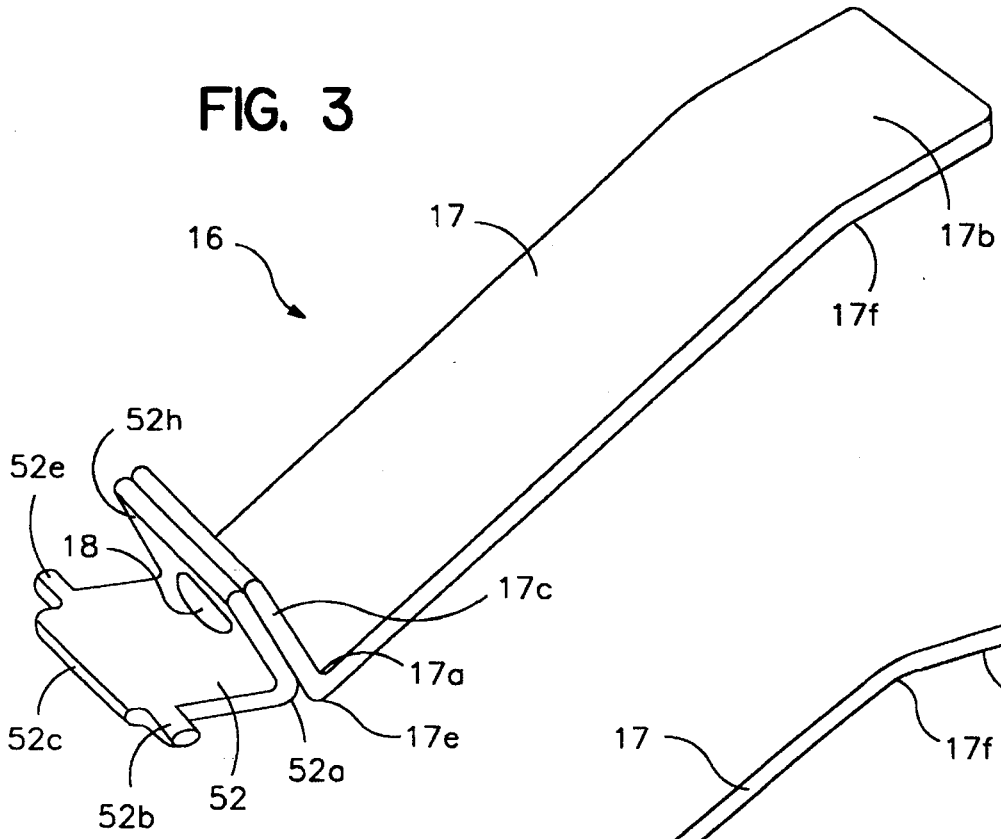
FIG. 3 is a perspective view of the preferred actuating lever from FIG. 1.
Figure 4:
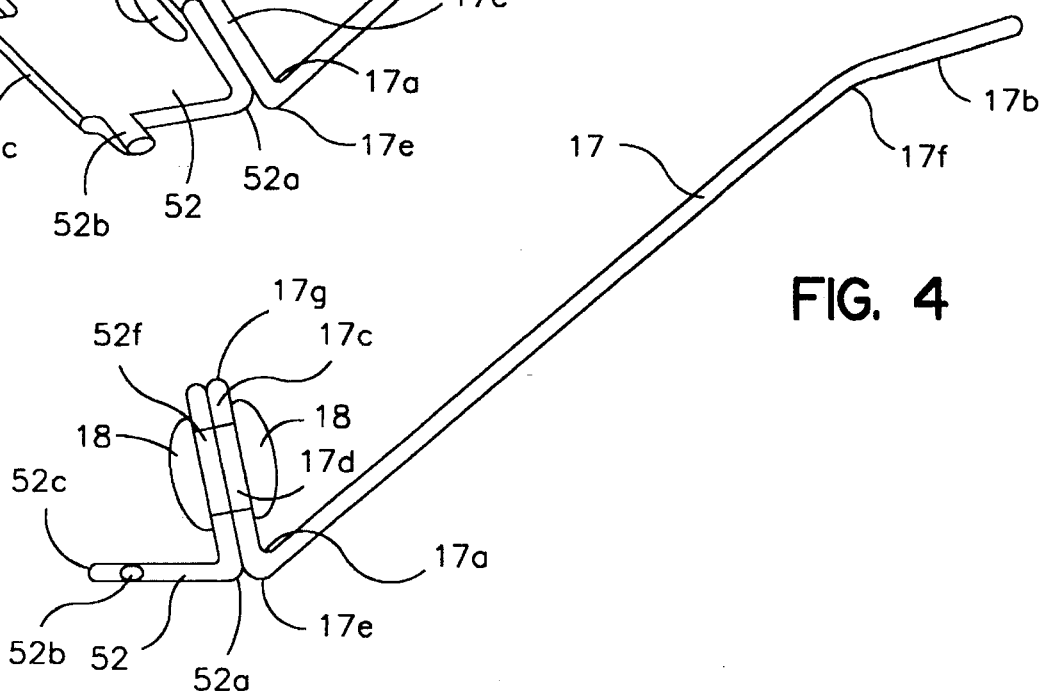
FIG. 4 is a side view of the preferred actuating lever in FIG. 3 in its active position.
Figure 5:
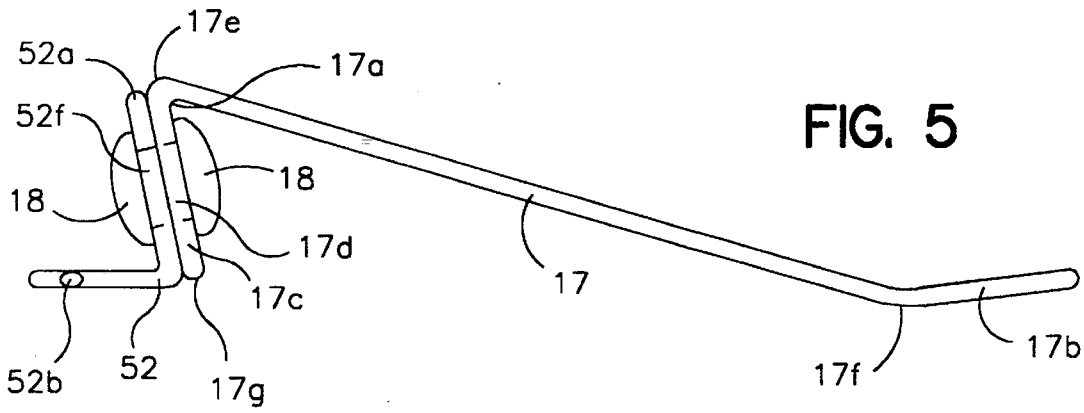
FIG. 5 is a side view of the preferred actuating lever in FIG. 3 in its inactive position, rotated 180 degrees about the rivet fastening the rotating portion of the actuating lever to the front plate.

Refer now to FIGS. 3 through 5, which represent different perspectives of the preferred actuating lever designated by character reference 16. The actuating lever's 16 rotating portion 17 is generally flat and is bent at 17*f*, continuing in an elongate planar section that forms the grasping end 17*b*. The opposite end of the actuating lever's 16 rotating portion 17 is bent at 17*a*, continuing in another elongate section 17*c* that has a cavity 17*d* for a fastening rivet 18. The bend at 17*a* forms a heel formation 17*e* of the actuating lever 16. The bend at 17*a* is at such an angle so that the point at 17*g* is parallel with the bend at 17*f* when the actuating lever 16 is in its inactive position (FIG. 5). The front plate 52 of the actuating lever 16 is the connecting piece that forms the mounting means for the actuating lever 16 to the side walls 4 and 6 of the device 10. The front plate 52 bends at 52*a*, defining angled portion 52*h* and there is a cavity 52*f* in the portion 52*h* for the fastening rivet 18. The rivet 18 tightly fastens the rotating portion 17 of the actuating lever 16 to the front plate 52 through their aligned cavities 17*d* and 52*f*, providing the pieces with steadiness and support. However, the rivet 18 still allows the rotating portion 17 to rotate 360 degrees to alternate between the active position portrayed in FIG. 4 and the inactive position depicted in FIG. 5 and vice versa.

The front plate 52 has opposite protruding ends 52*b* and 52*e* and a front edge 52*c* that extends from the protruding ends 52*b* and 52*e*. The ends 52*b* and 52*e* ride within the sockets 46 formed by the side walls 4 and 6, enabling the actuating lever 16 to be mounted to the finger/toe nail clipper and catcher 10.

When the actuating lever 16 is in its active position (as portrayed in FIG. 1, 3, and 4), the rotating portion 17 of the actuating lever 16 slopes upward, away from the elongate upper arm 14 with the heel formation 17*e* against the upper surface of the upper arm 14. In its active condition, the front area 4*a* and 6*a* of the side walls 4 and 6 provide side barriers for the actuating lever 16, preventing the actuating lever 16 from slipping sideways during use of the device 10. During use of the device 10, the grasping end 17*b* is pressed toward the upper arm 14. The heel formation 17*e* bears against the upper surface of the upper arm 14, forcing the upper jaw formation 14*a* of the upper arm 14 against the lower jaw formation 2*a* so that the cutting edges 32*a* and 34*a* and 42*a* and 44*a* engage against the finger/toe nail introduced between the jaw formations 14*a* and 2*a*, cutting said nail. When the device is in the process of cutting a nail, the interior chamber (24 of FIGS. 1 and 6) is completely isolated.

In order for the actuating lever 16 to alternate between the active and inactive positions, the grasping edge 17*b* must be lifted upward and then rotated 180 degrees around the rivet 18. When the actuating lever 16 is in its inactive position (as represented in FIG. 5), the rotating portion 17 of the actuating lever 16 is rotated 180 degrees from its active position. When the actuating lever 16 is in its inactive condition, the rotating portion 17 slopes downward, towards the upper surface of the elongate upper arm 14 with the heel formation 17*e* pointing upwards instead of bearing against the upper surface of the upper arm 14.

Figure 2:
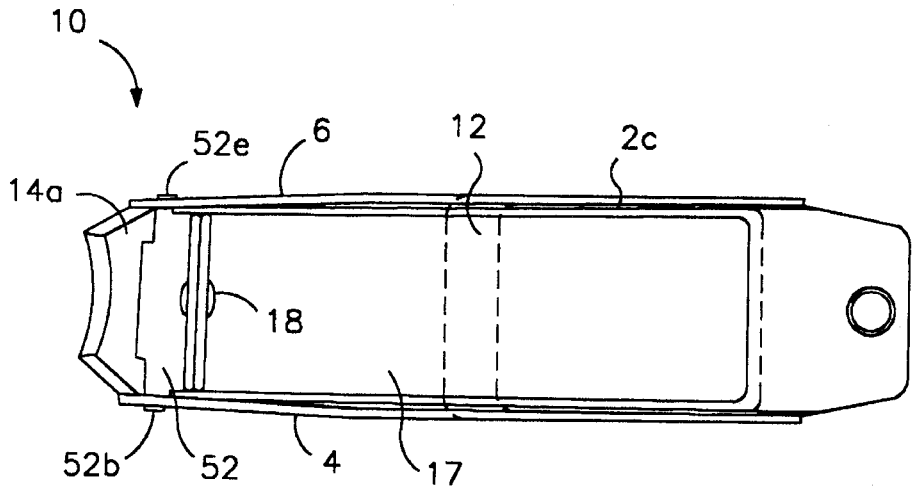
FIG. 2 is a top view of the finger/toe nail clipper portrayed in FIG. 1, with the preferred actuating lever in its active position and disposal hatch means in phantom outline.

In FIG. 1, the finger/toe nail clipper and catcher 10 is depicted with the disposal hatch 12 mounted to the undersurface of the lower arm 2 by the rivet 22 that also fastens the elongate upper arm 14 and elongate lower arm 2 together, said disposal hatch 12 extended sideways about the rivet 22 away from the body of the device 10 in FIG. 1. Refer now to FIG. 2. During the "cutting" stage, the disposal hatch 12 (depicted in phantom outline in the undersurface of the lower arm 2 ) is closed, covering the opening 2*c* where the accumulated nail clippings may be released. Refer back to FIG. 1. When the user is ready to dispose of the nail clippings collected within the chamber (24 of FIG. 6), the disposal hatch may be opened by swinging the hatch 12 to the side, allowing controlled means of discarding the accumulated nail clippings.

Figure 6:
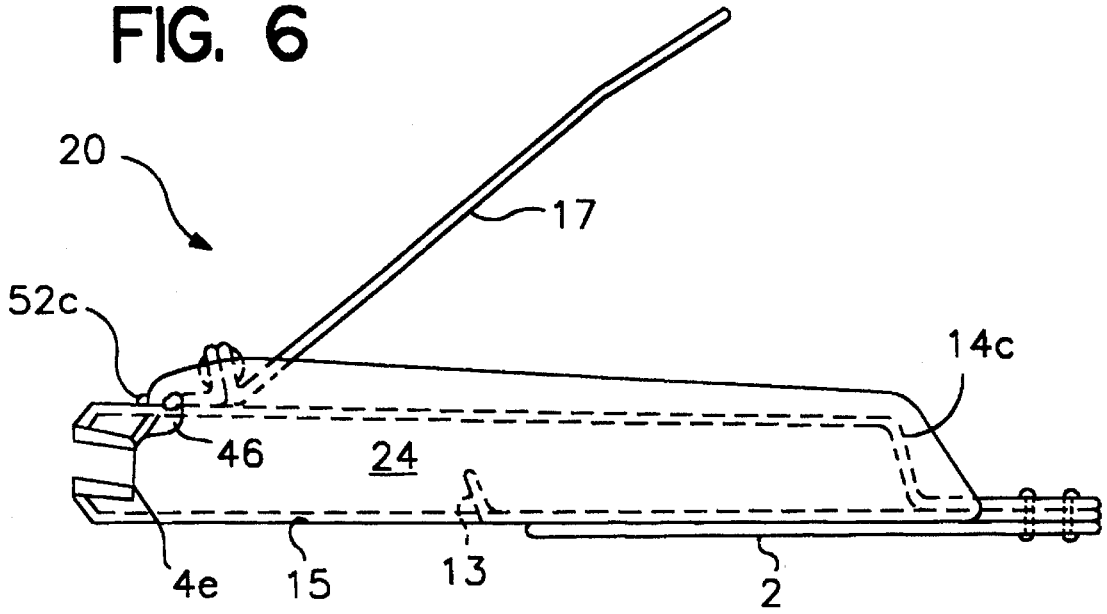
FIG. 6 is a side view of the finger/toe nail clipper depicted in FIG. 1 with modified deflection disposal means and upper and lower arms in phantom outline.
Figure 7:
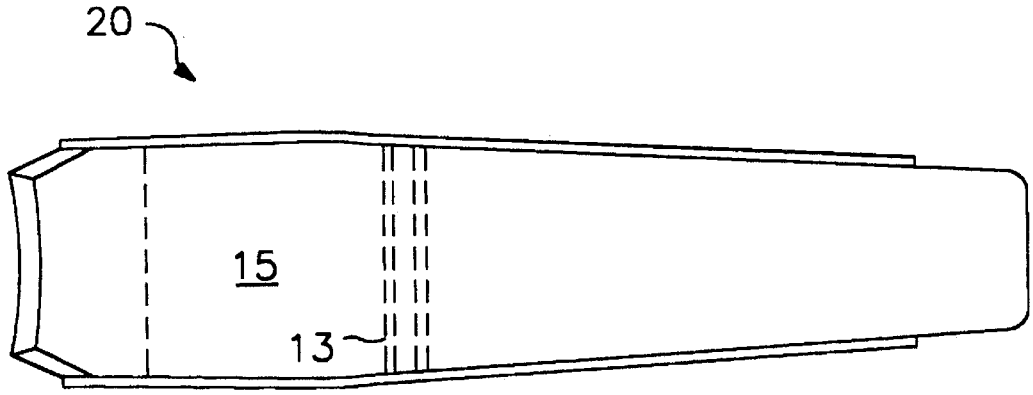
FIG. 7 is a top view of the finger/toe nail clipper in FIG. 1, showing the modified deflection disposal means in phantom outline.
Figure 8:
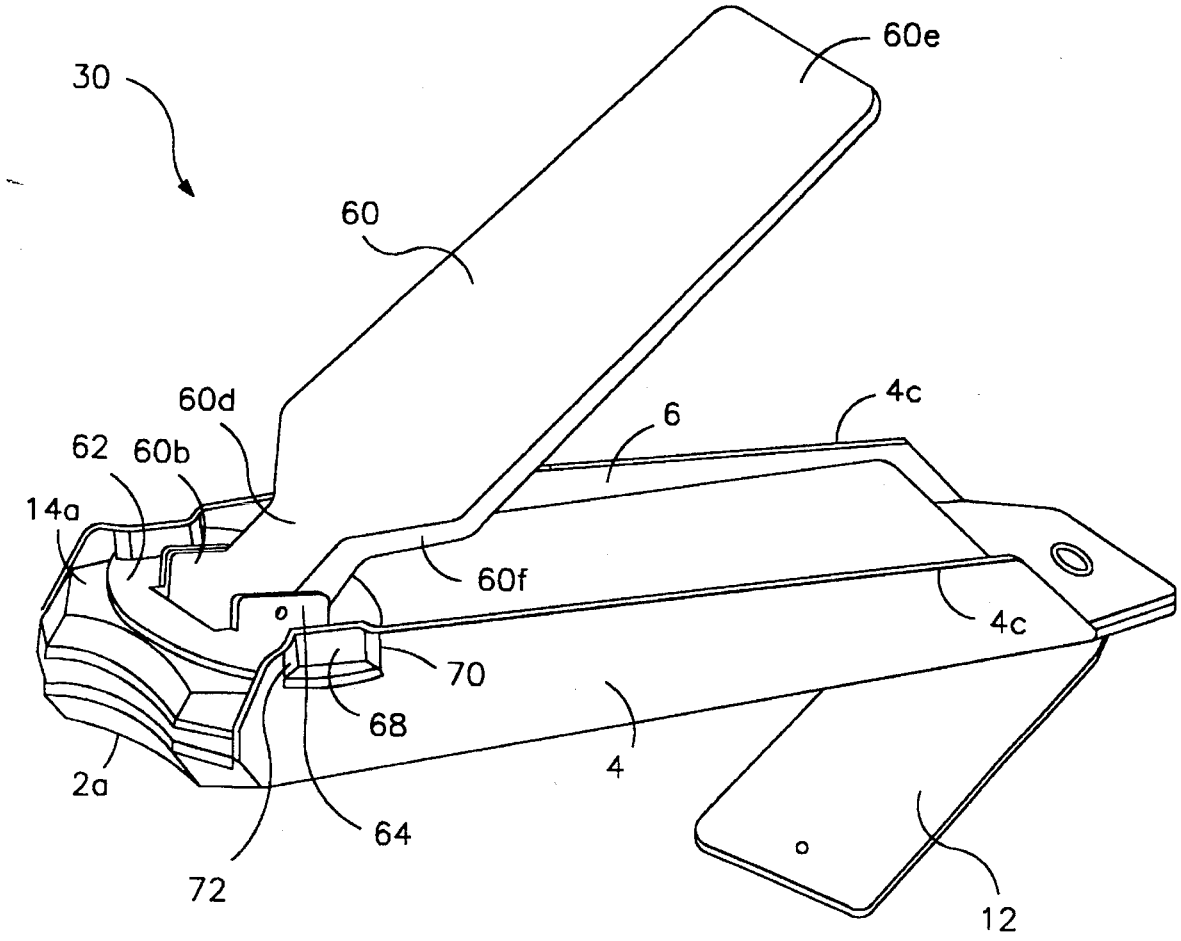
FIG. 8 is a perspective view of a modified embodiment of the finger/toe nail clipper depicted in FIG. 1 with the active actuating lever mounted by rotational disc means.
Figure 9:
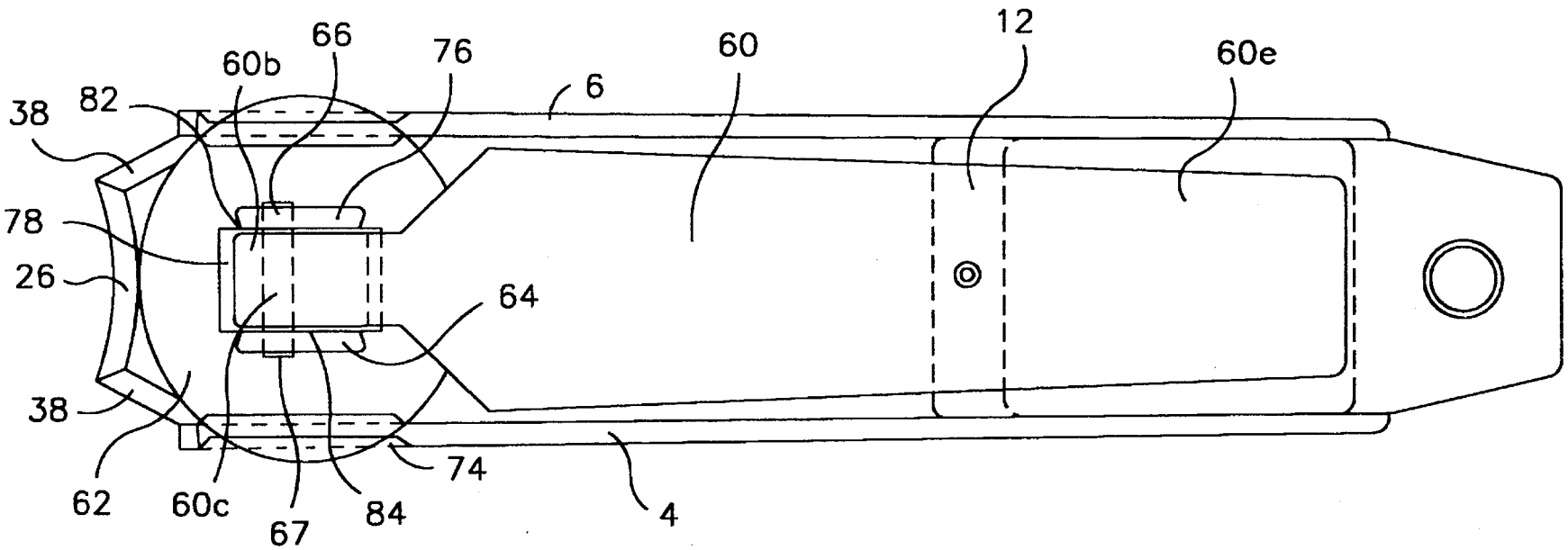
FIG. 9 is a top view of the finger/toe nail clipper in FIG. 8, with the preferred deflection disposal means in phantom outline.
Figure 10:
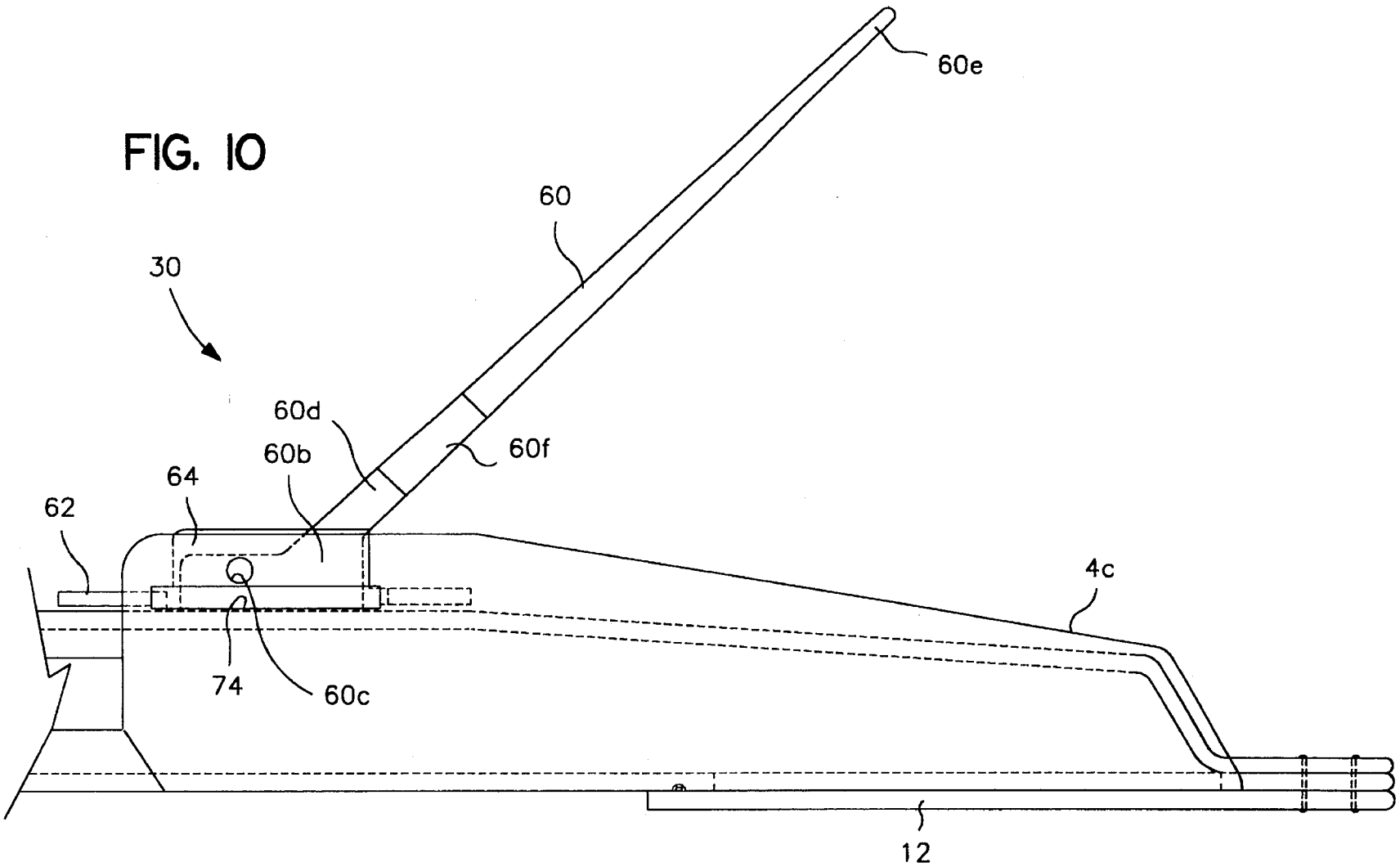
FIG. 10 is a fragmentary side view of the finger/toe nail clipper in FIG. 8, with the base or foot of the actuating lever and the upper and lower arms in phantom outline.

Refer to FIGS. 6 and 7, which represent a modified embodiment (designated by character reference 20) of the present invention's disposal means illustrated in FIG. 1. In FIG. 6, the phantom outlines reveal the interior chamber 24 and the deflection disposal means 13 located on the interior surface of the lower arm 2. In FIG. 7, the phantom outlines reveal the opening 15 in the interior surface of the lower arm 2. The angled deflector 13 provides controlled means of disposing of nail clippings. The lack of a mounting pin still allows for unobstructed entry of the nail clippings. However, instead of retaining the nail clippings for later disposal, in the modified disposal means 20, one can hold the device 10 above any container or other area of disposal. The deflector 13 will deflect nail clippings, which will then fall down through opening 15 in the lower arm 2 to the exterior of the device 10, providing controlled disposal of the finger/toe nail clippings. The deflector 13 does not extend all the way to the inner surface of the upper arm 14. It is sufficient that the deflector 13 extends upwards a sufficient distance without preventing the upper arm's 14 resilience, allowing the jaw formations 14*a* and 2*a* to engage the cutting edges 32*a* and 34*a* and 42*a* and 44*a*.

Referring to FIGS. 8 to 12, a modified embodiment of the present invention 10 is depicted and indicated by character reference 30. The modified embodiment 30 includes modified mounting means for the actuating lever. The actuating lever 60 is generally flat with a grasping end 60*e* and mounting base 60*b*. The actuating lever's 60 longitudinal edges are generally or nearly parallel until the edges diagonally indent inward at 60*f* and then continue in a parallel or nearly parallel direction 60*d* until the actuating lever 60 forms the base 60*b*. The base 60*b* of the actuating lever has a heel formation 60*g* and a horizontal cavity 60*c* that extends all the way through the base 60*b*. The lower surface of the base 60*b* touches the upper surface of the upper arm 14. The rotational disc 62 is a planar member that is circular or oval in shape with opposite facing mounting ears 64 and 76 extending vertically from the edges 82 and 84 of the axial passage 78 in the rotational disc 62. The mounting ears 64 and 76 each have a cavity 66 aligned with the other. The actuating lever's 60 base 60*b* fits into the axial passage 78 of the rotational disc 62. The base's 60*b* cavity 60*c* is aligned with the mounting ears' 64 and 76 cavities 66, and a pin 67 through the cavities 60*c* and 66 fastens the actuating lever 60 to the rotational disc 62.

Instead of the scroll-like slots 46 on the side walls 4 and 6 as in FIG. 1, FIGS. 8, 9 and 10 portray longitudinal slots 74 in each of the side walls 4 and 6. The upper edges 4*c* of the portions of the side walls 4 and 6 that extend above the upper surface of the elongate upper arm 14 indent diagonally at 70, continue in a longitudinal direction 68, and angle outward 72 proximate the jaw formations 14*a* and 2*a*. The angled and indented side walls formed by 68, 70, and 72 that form the indented niches have slots 74 on both side walls 4 and 6 where the rotational disc 62 rides and may rotate 360 degrees.

When the actuating lever 60 is in its active position (as portrayed in FIGS. 8 to 12), the actuating lever 60 slopes upward, away from the elongate upper arm 14 with the heel formation 60*g* against the upper surface of the upper arm 14. In its active condition, the mounting ears 64 and 76 of the rotational disc 62 provide side barriers for the actuating lever 60, preventing the actuating lever 60 from slipping sideways during use of the device 30. During use of the device 30, the grasping end 60*e* is pressed toward the upper arm 14. The heel formation 60*g* mounting bears against the upper surface of the upper arm 14, forcing the upper jaw formation 14*a* of the upper arm 14 against the lower jaw formation 2*a*. The heel formation 60*g* also keeps the actuating lever 60 in its active position by preventing the actuating lever 60 from falling towards the upper arm 14.

In order to alternate the actuating lever 60 to its inactive condition, the grasping end 60*e* is lifted so that the heel formation 60*g* no longer rests against the upper surface of the upper arm 14. The actuating lever 60—rotational disc 62 unit is rotated 180 degrees so that the upper surface of the active actuating lever 60 faces downward and becomes parallel to the upper arm 14, resting against the upper arm 14 until the device 30 is rotated back into its active condition. The rotational disc 62 rotates within the longitudinal slots 74 of the side walls 4 and 6.

The foregoing descriptions of the preferred and modified embodiments of the invention have been presented for the purposes of illustration and description. They are not intended to be exhaustive or to limit the invention to the precise form disclosed. Many modifications and variations are possible in light of the above teaching. It is intended that the scope of the invention be limited not by this detailed description, but rather by the claims appended hereto.

What is claimed is:

1. In a finger/toe nail clipper assembly including elongate upper and lower arms having first ends and opposite second ends secured together, said arms arranged in overlying horizontally spaced planes from a location proximate the secured ends thereof; the first ends terminating in facing jaw formations having concave blade sections terminating in sharpened cutting edges; generally vertical side walls formed along the longitudinal edges of the lower arm; the upper arm having limited resilience with the blade sections of the jaw formations defining an entrance for receiving the finger/toe nail introduced therebetween; aligned sockets formed in said side walls at a location above said jaw formations and having an entrance opening, an actuating lever associated with said assembly for pivotal movement in selective bearing relationship with the upper arm at a location proximate the jaw formation thereof so as to force the cutting edges of the blade sections into engagement for severing the finger/toe nail introduced therebetween; the actuating lever having oppositely directed sidewise projections of size and configuration enabling seating thereof within said sockets via the entrance opening of the sockets; the improvement comprising:

said vertical side walls being unitary with the longitudinal edges of the lower arm along substantially the length thereof; said blade sections facing inwardly and including angular side blade sections terminating in sharpened straight-line cutting edges and engaging said side walls defining an unobstructed entrance to a fully enclosed interior chamber for receiving, storing and preventing outward scattering of nail clippings during use of said assembly while enabling said unobstructed entrance to accommodate finger/toe nails of varied length and width; said actuating lever having an angled mounting plate seatable upon the upper arm and an elongate rotatable portion, said mounting plate including a front portion having a unitary angular arm defining a canted surface; said elongate rotatable portion having a unitary bend at one end having a canted surface extending at an angle complementary to said canted surface of said unitary angular arm and an opposite end terminating in a grasping portion; bearing/fastening means coupling said unitary angular arm and said unitary bend with said canted surfaces of said unitary arm and unitary bend substantially engaged in parallel planes enabling said elongate rotatable portion to rotate about said unitary angular arm between an active condition with said elongate rotatable portion extending diagonally away from said upper arm and an inactive condition whereat said elongate rotatable portion is inverted from its active condition with said grasping portion thereof being closely proximate said upper arm.

2. The finger/toe nail clipper assembly according to claim 1 in which said unitary angular arm and said unitary bend are each oriented at an acute angle.

3. The finger/toe nail clipper assembly according to claim 1 in which said front portion includes a planar section which is seatable upon said upper arm proximate said upper jaw formation.

4. The finger/toe nail clipper assembly according to claim 1 in which said unitary bend of said rotatable portion defines a heel formation having an edge capable of bearing against said upper arm when said actuating lever is in the active condition whereby to prevent undesired rotation of said rotatable portion during use of said assembly.

5. The finger/toe nail clipper assembly according to claim 1 in which said unitary bend of said rotatable portion defines a heel formation having a wide edge capable of bearing against said upper arm when said actuating lever is in the active condition whereby to prevent undesired movement of said rotatable portion during use of said assembly.

6. The finger/toe nail clipper assembly according to claim 1 in which said side walls extend vertically higher than the upper arm along a location proximate the heel formation of said actuating lever whereby to prevent sideways movement of said actuating lever disposed between said side walls.

7. In a finger/toe nail clipper assembly including elongate upper and lower arms having first ends and opposite second ends secured together, the arms arranged in overlying horizontally spaced substantially parallel planes from a location proximate the secured second ends thereof; the first ends terminating in facing jaw formations having concave blade sections terminating in sharpened cutting edges; generally vertical side walls formed along the longitudinal edges of the lower arm; the upper arm having limited resilience with the blade sections of the jaw formations defining an entrance for receiving the finger/toe nail introduced therebetween; aligned passages formed in the side walls at a location above the jaw formations and proximate thereto and having an entrance opening; an actuating lever associated with said assembly for pivotal movement in selective bearing relationship with said upper arm at a location proximate the jaw formation thereof so as to force the cutting edges of the blade sections into engagement for severing the finger/toe nail introduced therebetween; the actuating lever having oppositely directed side-wise projections of size and configuration enabling seating thereof within said aligned passages via the entrance openings thereof; the improvement comprising:

said generally vertical side walls being unitary with the longitudinal edges of the lower arm along substantially the length thereof; said blade sections facing inwardly and including angular side blade sections terminating in sharpened straight-line cutting edges and engaging said side walls defining an unobstructed entrance to a fully enclosed interior chamber for receiving, storing and preventing outward scattering of nail clippings during use of said assembly while enabling said unobstructed entrance to accommodate finger/toe nails of varied length and width; and said actuating lever comprising a front plate having a planar portion seatable on said upper arm and having a unitary angularly bent portion defining a canted surface; an elongate rotatable portion diagonally directed relative said front plate; said front plate having a leading edge; the oppositely directed side-wise projections being unitary with said front plate at a location adjacent said leading edge; said elongate rotatable portion having a unitary bend at one end and a grasping portion at the opposite end thereof; said unitary bend being at an angle and having a surface complementary to said canted surface of said angularly bent portion of said front plate; said angularly bent portion of said front plate and said unitary bend of said elongate rotatable portion respectively having aligned openings formed therein and are engaged substantially surface to surface; and a fastener/bearing seated through said aligned openings joining said unitary angularly bent portion of said front plate and said unitary bend of said elongate rotatable portion to enable rotation of said elongate rotatable portion between an active condition divergent from said upper arm and an inactive condition directed toward said upper arm the opposite side-ways directed projections being engaged within the aligned side-wall passages to permit pivoting of said actuating lever during the active condition thereof enabling force to be applied by the actuating lever to the upper arm for bringing said cutting edges of said blade sections into severing engagement with a finger/toe nail introduced between the jaw formations severing said finger/toe nail.

8. In a finger/toe nail assembly including elongate upper and lower arms having first ends and opposite second ends secured together, the arms arranged in overlying horizontally spaced substantially parallel planes from a location proximate the secured ends thereof; the first ends terminating in facing jaw formations having concave blade sections terminating in sharpened cutting edges; generally vertical side walls formed along the longitudinal edges of the lower arm; the upper arm having limited resilience with the blade sections of the jaw formations defining an entrance for receiving the finger/toe nail introduced therebetween; aligned passages formed in the side walls at a location above the jaw formations proximate thereto and having an entrance opening theretoward; an actuating lever associated with said assembly for pivotal movement in selective bearing relationship with the upper arm at a location proximate the jaw formation thereof so as to force the cutting edges of the blade sections into engagement for severing the finger/toe nail introduced therebetween; the actuating lever having oppositely directed side-wise projections of size and configuration enabling seating thereof within the aligned passages via the entrance thereto; the improvement comprising:

said generally vertical side walls being unitary with the longitudinal edges of said lower arm along substantially the length thereof; said blade sections facing inwardly and including angular side blade sections terminating in sharpened straight-line cutting edges and engaging said side walls defining an unobstructed entrance to a fully enclosed interior chamber for receiving, storing and preventing outward scattering of nail clippings during use of said assembly while enabling said unobstructed entrance to accommodate finger/toe nails of varied length and width; and said actuating lever comprising an angled front plate having a canted surface and a planar portion having a leading edge and the oppositely directed side-wise projections being adjacent said leading edge; and an elongate rotatable portion diagonally directed relative said front plate; said front plate and planar portion thereof being seatable over said upper arm of said assembly between said side walls thereof; said elongate rotatable portion having an unitary bend at one end thereof and a grasping portion at the opposite end thereof; said unitary bend being at an angle and having a canted surface complementary to said canted surface of said front plate; said canted surfaces of said front plate and said unitary bend of said elongate rotatable portion having aligned openings formed therein; a fastener/bearing seated through said aligned openings with said canted surfaces of said front plate and said unitary bend of said elongate rotatable portion being coupled together in substantially surface to surface engagement enabling rotation of said elongate rotatable portion between an active condition divergent from said upper arm and an inactive condition directed toward said upper arm; said side-wise directed projections of said front plate being engaged within the aligned passages of said side walls with said unitary bend of said elongate rotatable portion defining a heel formations capable of exercising bearing force upon said upper arm when said actuating lever is manipulated toward said upper arm forcably to bring said blade sections and the cutting edges thereof into severing engagement with a finger/toe nail introduced therebetween.

9. The finger/toe nail clipper assembly according to claim 7 in which said canted surface and said unitary bend each respectively define an acute angle.

10. The finger/toe nail clipper assembly according to claim 7 in which said unitary bend of said elongate rotatable portion of said actuating lever defines a heel formation having an edge capable of bearing against the upper arm when said actuating lever is in active condition whereby to prevent undesirable movement of said rotatable portion during use of said assembly.

11. In a finger/toe nail clipper assembly including upper and lower arms having first ends and opposite second ends secured together, the arms arranged in overlying horizontally spaced substantially parallel planes from a location proximate the secured second ends thereof; the first ends terminating in facing jaw formations having concave blade sections terminating in sharpened cutting edges; generally vertical side walls formed along the longitudinal edges of the lower arm; the upper arm having limited resilience with the blade sections of the jaw formations defining an entrance for receiving the finger/toe nail introduced therebetween; aligned passages formed in the side walls at a location above the jaw formations and an actuating lever associated with said assembly for pivotal movement in selective bearing relationship with said upper arm at a location proximate the jaw formations thereof so as to force the cutting edges of the blade sections into engagement for severing the finger/toe nail introduced therebetween; the improvement comprising:

the vertical side walls being unitary with the longitudinal edges of the lower arm along substantially the length thereof; said blade sections facing inwardly and including angular side blade sections terminating in sharpened straight-lien cutting edges and engaging said side walls defining an unobstructed entrance to a fully enclosed interior chamber for receiving, storing and preventing outward scattering of nail clippings during use of said assembly while enabling said unobstructed entrance to accommodate finger/toe nails of varied length and width; the aligned passages are formed as elongate opposite closed ended parallel coextensive slots and a planar disc member having diametrically opposite axial edge portions and an axial opening; vertically oriented ear means carried by said planar disc member located adjacent said axial opening; said vertically oriented ear means having aligned bores; said actuating lever having a base and an elongate outwardly extending lever portion unitary therewith; said base having opposite pins outwardly extending therefrom and seated within said aligned bores of said ear means pivotally securing said base and said elongate outwardly extending lever portion to said planar disc member at the axial opening thereof with said planar disc member positioned over the upper arm between the side walls at a location adjacent said elongate closed ended slots and being capable of rotation selectively at least 180 degrees with the diametrically opposite axial edge portions of said planar disc member riding within said elongate closed ended slots for retention of said planar disc member therein; said base including a heel formation capable of applying force to said upper arm upon pivotal manipulation of said elongate lever portion theretoward forcing said upper arm and the jaw formation thereof to bring said blade sections and the cutting edges thereof into severing engagement with a finger/toe nail introduced through said unobstructed entrance.

12. The finger/toe nail clipper assembly according to claim 11 in which said base carries a horizontal bore therethrough and said outwardly extending pins comprise the opposite ends of an elongate pin passed through said bore.

13. The finger/toe nail clipper assembly according to claim 11 in which said planar disc is oval in configuration.

14. The finger/toe nail clipper assembly according to claim 11 in which said side walls are indented along said closed ended slots, said diametrically opposite axial edge portions of said planar disc being selectively disposable within said slots below the indented portions.

15. The finger/toe nail clipper assembly according to claim 11 in which said base is rectangular in configuration and has a rounded corner defining said heel formation.

16. The finger/toe nail clipper assembly according to claim 1 including disposal hatch means for disposing the severed nail clippings from the interior of said assembly; said disposal hatch means comprising an elongate longitudinal disposal opening is formed in said lower arm within said interior chamber and a disposal hatch comprising an elongate cover plate pivotally secured to the undersurface of said lower arm proximate to said disposal opening for sideways swingable horizontal movement between a position for gaining exterior access to said interior of said assembly and a position covering said opening.

17. The finger/toe nail clipper assembly according to claim 1 in which an elongate longitudinal disposal opening is formed in said lower arm within said interior chamber, an angled deflector positioned within said interior chamber adjacent said longitudinal opening, said angled deflector defining an angled deflector surface, said deflector surface facing said opening for reboundingly directing the nail clippings toward said opening and an an elongate cover plate pivotally secured to the lower arm adjacent said opening for sideways swingable horizontal movement between a position for gaining exterior full access to said interior chamber of said assembly and a position covering said opening.

18. The finger/toe nail clipper assembly according to claim 17 in which said angled deflector is formed on the lower arm.

19. The finger/toe nail clipper assembly according to claim 17 in which said angled deflector is proximate the secured ends of said upper and lower arms.

20. In a finger/toe nail clipper assembly including elongate upper and lower spaced generally horizontally overlying arrangement, the arms each having first ends and opposite second ends, the second ends secured together, the first ends terminating in facing jaw formations having concave blade sections terminating in sharpened cutting edges; generally vertical side walls formed along the longitudinal edges of the lower arm; the upper arm having limited resilience with the blade sections of the jaw formation defining an entrance for receiving the finger/toe nail introduced therethrough; passage means formed in the side walls at a location above the jaw formations and proximate thereto and an actuating lever having means engagable within the passage means enabling pivotal movement in selective bearing relationship with the elongate upper arm at a location proximate the jaw formation thereof so as to force the sharpened cutting edges of the blade sections into engagement for severing the finger/toe nail introduced therebetween; the improvement comprising:

said actuating lever having an angled mounting plate seatable upon the upper arm and an elongate rotatable portion, said mounting plate including a front portion having a unitary angular arm defining a canted surface, said elongate rotatable portion having a unitary bend at one end extending at an angle complementary to said canted surface of said unitary angular arm and terminating in a grasping portion at the opposite end of said elongate rotatable portion, bearing/fastening means coupling said unitary angular arm and unitary bend engaged in parallel planes enabling said elongate rotatable portion to rotate about said unitary angular arm between an active condition with said elongate rotatable portion extending diagonally away from said upper arm and an inactive condition whereat said elongate rotatable portion is inverted from its active condition with said grasping end thereof being closely proximate said upper arm.

21. The finger/toe nail clipper assembly according to claim 20 in which said canted surface and said unitary bend are each oriented at an acute angle.

22. The finger/toe nail clipper assembly according to claim 20 in which said front portion includes a planar section which is seatable upon said upper arm proximate said upper jaw formation.

23. The finger/toe nail clipper assembly according to claim 20 in which said unitary bend of said rotatable portion defines a heel formation having an edge capable of bearing against said upper arm when said actuating lever is in the active condition whereby to prevent undesired movement of said rotatable portion during use of said assembly.

24. The finger/toe nail clipper assembly according to claim 20 in which said unitary bend of said rotatable portion defines a heel formation having a wide edge capable of bearing against said upper arm when said actuating lever is in the active condition whereby to prevent undesired rotation of said rotatable portion during use of said assembly.

25. The finger/toe nail clipper assembly according to claim 20 in which said front portion includes a planar portion having a leading edge and a pair of opposite outwardly protruding side portions adjacent said leading edge, said protruding side portions being of size and configuration for receipt within said passage means with said front plate seated on the upper arm of said assembly between the side walls thereof.

26. The finger/toe nail clipper assembly according to claim 20 in which said assembly includes an interior chamber for collecting and storing the severed nail clippings resulting from use of said assembly and disposal hatch means for gaining access to said interior chamber for disposing of said severed nail clippings, said disposal hatch means comprising an elongate longitudinal opening formed in said lower arm of said assembly within said interior chamber thereof and an elongate cover plate pivotally secured to the undersurface of said lower arm proximate to said longitudinal opening for sideways swingable horizontal movement between a position for gaining exterior access to said interior chamber and a position covering said opening.

27. The finger/toe nail clipper assembly according to claim 26 wherein an angled deflector is positioned on the lower arm of said assembly and located adjacent said longitudinal opening within said interior chamber, said angled deflector defining an canted deflector surface facing said opening for reboundingly directing the nail clippings toward said opening.

28. The finger/toe nail clipper assembly according to claim 27 in which said angled deflector is formed on the lower arm of said assembly.

29. The finger/toe nail clipper assembly according to claim 17 in which said angled deflector is proximate the secured ends of said upper and lower arms of said assembly.

30. In a finger/toe nail clipper assembly including elongate upper and lower spaced generally horizontally overlying arrangement, the arms each having first ends and opposite second ends, the second ends secured together, the first ends terminating in facing jaw formations having concave blade sections terminating in sharpened cutting edges; generally vertical side walls formed along the longitudinal edges of the lower arm; the upper arm having limited resilience with the blade sections of the jaw formations defining an entrance for receiving the finger/toe nail introduced therebetween; passage means formed in the side walls at a location above the jaw formations and proximate thereto and an actuating lever having means engagable within the passage means enabling pivotal movement to bring said actuating lever into bearing relationship with the elongate upper arm at a location proximate the jaw formation thereof so as to force the sharpened cutting edges of the blade sections into engagement for severing the finger/toe nail introduced therebetween; the improvement comprising:

said actuating lever comprising a planar disc member having diametrically opposite edge portions and an axial opening, vertically oriented ear means carried by said planar disc member adjacent said axial opening, said ear means having aligned bores, a base portion and an elongate outwardly extending lever portion unitary therewith, said base portion having opposite pins outwardly extending therefrom and seated within said aligned bores pivotally securing said base portion to said planar disc, said passage means comprise elongate opposite aligned closed ended parallel slots, said planar disc being seatable upon said upper arm and capable of at least 180 degrees rotation with at least a pair of said opposite edge portions thereof riding within said elongate closed ended slots with said planar disc seated upon said upper arm and between said side walls, said base portion including a heel formation capable of applying force to said upper arm upon manipulation of said elongate outwardly extending lever portion toward said upper arm forcing said upper arm and said jaw formation thereof to bring said blade sections and the cutting edges thereof into severing engagement with a finger/toe nail introduced into said assembly.

31. The finger/toe nail clipper assembly according to claim 30 in which said base carries a horizontal bore therethrough and said outwardly extending pins comprise the ends of an elongate pin passed through said bore.

32. The finger/toe nail clipper assembly according to claim 30 in which said planar disc is oval in perimetric configuration.

33. The finger/toe nail clipper assembly according to claim 30 in which said base is generally rectangular in configuration and has a rounded corner defining said heel formation.

34. The finger/toe nail clipper assembly according to claim 30 in which said side walls are indented along said elongate closed ended slots and said planar disc is oval in perimetric configuration having diametrically axially longer edge portions being disposable within said elongate closed ended slots beneath the indented portions of said side walls.

35. The finger/toe nail clipper assembly according to claim 30 in which said assembly includes an interior chamber for collecting and storing the severed nail clippings resulting from use of said assembly and disposal hatch means for gaining access to said interior chamber for disposing of said severed nail clippings, said disposal hatch means comprising an elongate longitudinal opening formed in said lower arm of said assembly within said interior chamber thereof and an elongate cover plate pivotally secured to the undersurface of said lower arm proximate to said longitudinal opening for sideways swingable horizontal movement between a position for gaining exterior access to said interior chamber and a position covering said opening.

36. The finger/toe nail clipper assembly according to claim 35 wherein an angled deflector is positioned on the lower arm of said assembly and located within said interior chamber adjacent said opening, said angled deflector defining an angled deflector surface facing said opening for reboundingly directing the nail clippings toward said opening during use of said assembly.

37. The finger/toe nail clipper assembly according to claim 36 in which said angled deflector is formed on the lower arm of said assembly.

38. The finger/toe nail clipper assembly according to claim 36 in which said angled deflector is proximate the secured ends of said upper and lower arms of said assembly.

* * * * *